United States Patent [19]

Dress, Jr. et al.

[11] Patent Number: 4,471,403

[45] Date of Patent: Sep. 11, 1984

[54] BIASING AND FAST DEGAUSSING CIRCUIT FOR MAGNETIC MATERIALS

[75] Inventors: William B. Dress, Jr., Lenoir City; David R. McNeilly, Maryville, both of Tenn.

[73] Assignee: The United States of America as represented by the United States Department of Energy, Washington, D.C.

[21] Appl. No.: 539,011

[22] Filed: Oct. 4, 1983

[51] Int. Cl.[3] ..... H01F 13/00

[52] U.S. Cl. ..... 361/149; 361/143; 361/267

[58] Field of Search ..... 361/149, 150, 267, 143; 315/8; 360/118, 66

[56] References Cited

U.S. PATENT DOCUMENTS

| | | | |
|---|---|---|---|
| 3,588,624 | 6/1971 | Marvin | 361/149 |
| 3,784,868 | 1/1974 | Swinkai et al. | 361/150 |
| 3,895,270 | 7/1975 | Maddox | 361/149 |

OTHER PUBLICATIONS

"Degaussing Circuits for Color Television Receivers", Robert F. Blaha, IEEE Trans. Broadcast and Tel. Rec., (USA), vol. BTR 18, No. 1, Feb. 1972.

*Primary Examiner*—Reinhard J. Eisenzopf

*Attorney, Agent, or Firm*—David E. Breeden; Stephen D. Hamel; Michael F. Esposito

[57] ABSTRACT

A dual-function circuit is provided which may be used to both magnetically bias and alternately, quickly degauss a magnetic device. The circuit may be magnetically coupled or directly connected electrically to a magnetic device, such as a magnetostrictive transducer, to magnetically bias the device by applying a d.c. current and alternately apply a selectively damped a.c. current to the device to degauss the device. The circuit is of particular value in many systems which use magnetostrictive transducers for ultrasonic transmission in different propagation modes over very short time periods.

6 Claims, 3 Drawing Figures

BIASING AND FAST DEGAUSSING CIRCUIT FOR MAGNETIC MATERIALS

BACKGROUND OF THE INVENTION

This invention relates generally to devices for degaussing magnetic materials and more specifically to a circuit for magnetically biasing and fast degaussing of a magnetic device.

This invention was the result of a contract with the United States Department of Energy.

Various devices are known which utilize a magnetostrictive transducer to excite various vibratory motions in an acoustic conductor or drive member of the device. One example, is a device for measuring liquid level in varying temperature and pressure environments which is the subject of a U.S. patent application Ser. No. 314,915(79) now abandoned, the disclosure of which is incorporated herein by reference thereto. In this device the liquid level is measured by immersing an elongated conductor element in the liquid and propagating ultrasonic acoustic wave energy in both longitudinal and torsional propagation modes by means of alternately pulsing a magnetostrictive transducer forming a portion of the conductor element.

In order to excite these alternate modes in a single transducer, it has been the practice to magnetically bias, or polarize, the magnetostrictive material of the transducer by either passing a small d.c. current through the material during pulsing or permanently polarizing the material by passing a large d.c. current (100 amps) through the material prior to assembly of the device. This approach works quite well if only a single mode of excitation is used. To excite a torsional wave in the rod, a coil wound about the polarized magnetostrictive rod is pulsed to generate a magnetic field which superimposes with the circumferential magnetic field in such a manner to generate the torsional wave. However, to excite a longitudinal wave in the rod, this circumferential field must be cancelled, since a longitudinal wave is produced by generating a magnetic field parallel to the rod. To accomplish this in the above-referenced device, a permanent magnet is placed near a second coil wound about the polarized rod and oriented to cancel the circumferential field, and to induce a longitudinal field.

A limitation on ultrasonic transducer systems of this type or others which alternate between different propagating modes is that any remaining magnetism from the previous magnetic field produced by the drive pulses can cause production of unwanted pulses and can also weaken the desired pulses should magnetic saturation be reached.

The solution to the problem is to demagnetize the magnetostrictive material thoroughly between alternating biasing arrangements. In a situation which requires rapid switching between various modes, as in the above-referenced system, demagnetization must be done quickly and efficiently. Thus, there is a need for a device to selectively magnetically bias a magnetic material and subsequently quickly degauss the material between alternate modes of magnetostriction.

SUMMARY OF THE INVENTION

In view of the above need, it is an object of this invention to provide a device for rapidly degaussing a magnetic material.

Further, it is an object of this invention to provide a circuit for alternately applying a magnetic bias to a magnetic material and rapidly degaussing the magnetic material.

Other objects and many of the attendant advantages of the present invention will be apparent to those skilled in the art from the following detailed description of the preferred embodiment of the invention taken in conjunction with the drawings and claims.

Briefly, a degaussing circuit is provided which includes a switching circuit connected to a series load resistor so that when the switch is activated a load current flows through the resistor. An L-C tank circuit is connected so that it is driven by the voltage drop across the load resistor during the switch's "on" period. The voltage across the tank circuit is fed to a voltage-to-current converter. The current from the converter is coupled to the magnetic material so that the material may be magnetically biased during the time the switch is "on" and immediately degaussed when the switch is turned "off" due to the oscillating current generated by the tank circuit which oscillates at its natural frequency. The load resistor is selected to control the damping rate of the oscillations, thereby controlling the degaussing period.

The current from the voltage-to-current converter may be used to drive a coil wound about the magnetic material to provide the desired magnetic bias, or polarization, and subsequent degaussing. Alternatively, the current may be fed through the material to provide the desired magnet polarization and subsequent degaussing.

BRIEF DESCRIPTION OF THE DRAWINGS

The accompanying drawings, which are incorporated in and form a part of the specification, together with the description, serve to explain the principles of the invention. In the drawings.

DETAILED DESCRIPTION OF THE INVENTION

Figure 1:
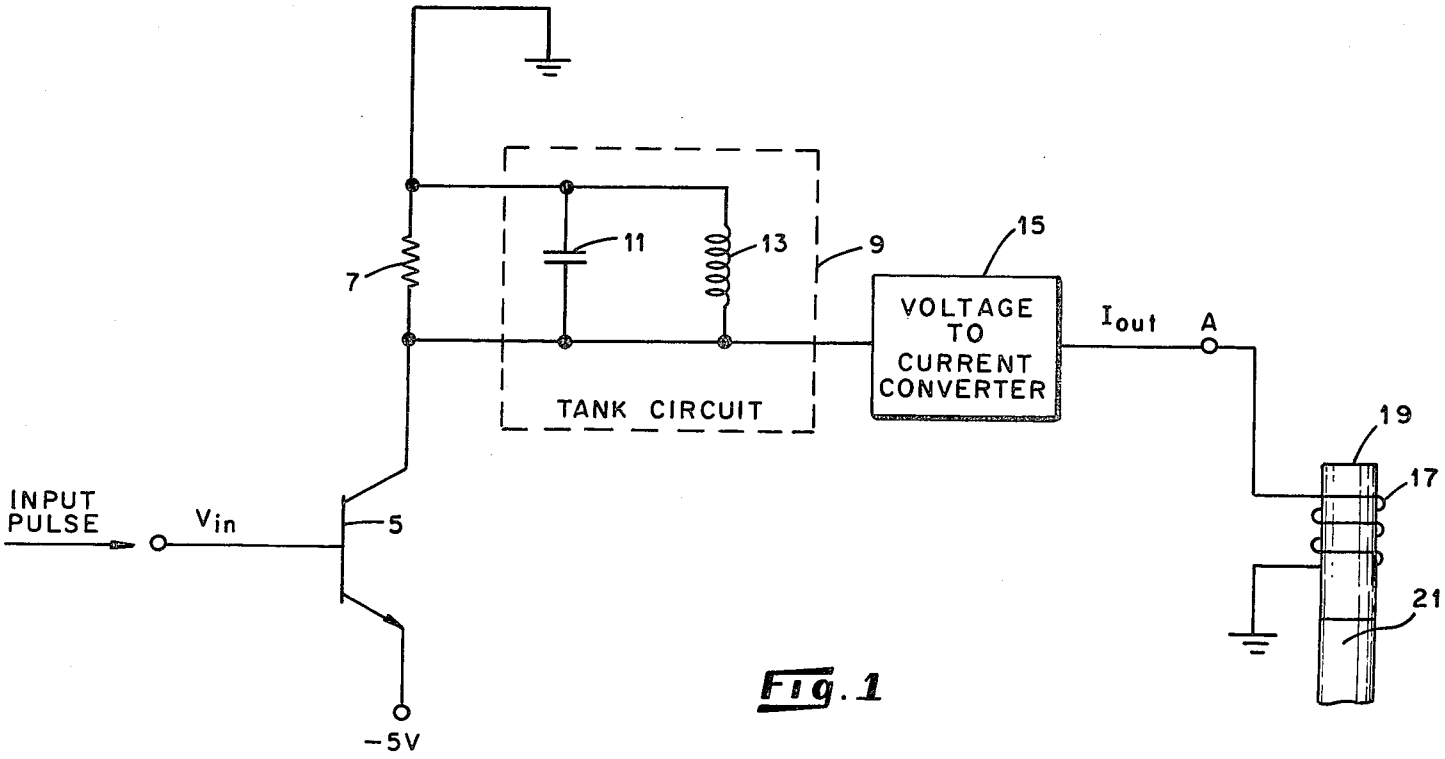
FIG. 1 is a schematic diagram of a degaussing circuit in which a coil is wound about a magnetic material to be magnetically polarized and degaussed according to the present invention.
Figure 3:
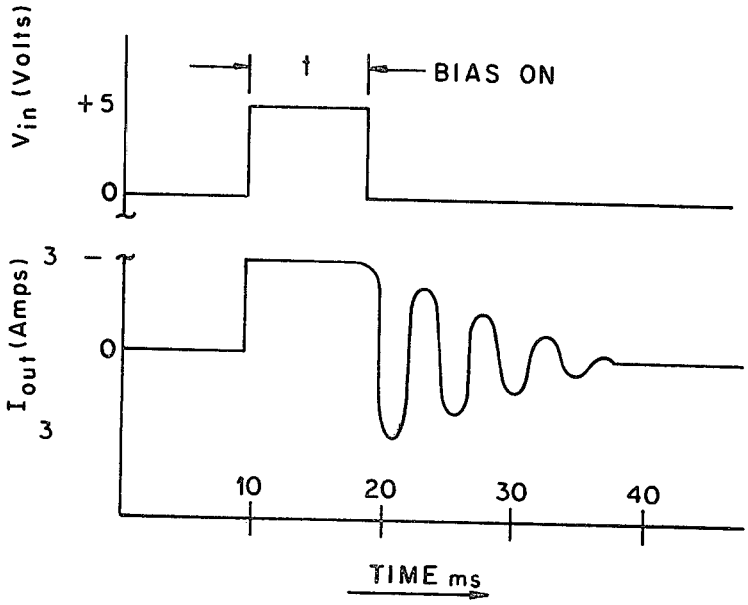
FIG. 3 is a plot illustrating the timing relationship and amplitude of input signal ($V_{in}$) and the output current ($I_{out}$) of the circuit of FIG. 1.

Referring now to FIG. 1, a degaussing circuit according to the present invention is shown having a switch in the form of a transistor 5 connected in series with a load resistor 7 having one end connected to the collector electrode of the transistor. The emitter of transistor 5 is connected to a −5 V power supply and the other end of resistor 7 is connected to ground. The base electrode of transistor 5 is connected to receive input pulses which control the switching of the transistor in accordance with a desired biasing and subsequent degaussing cycle. A tank circuit 9 including a parallel connected capacitor 11 and inductor 13 is connected in parallel with the load resistor 7. When the switch 5 is turned on by a positive going input pulse, as shown in FIG. 3, applied to the base electrode, the voltage drop of essentially −5 V across resistor 7 is applied to the tank circuit 9. This voltage is also applied to the input of a voltage-to-current converter 15 connected to the tank circuit 9. The converter 15 generates a current ($I_{out}$) at an output terminal A which is supplied to one end of a coil 17 wound about a magnetic device 19. The opposite end of coil 17 is connected to ground.

It will be understood that the magnetic device 19 may take various forms and the coil configuration may be changed to provide the desired magnetic polarization of the particular device during the "on" time of the switching circuit and subsequent degaussing of the device. For example, the device 19 may be a magnetostrictive transducer for a liquid level detector sensor rod 21 (partially shown) as in the above-referenced application. In this application the d.c. current flowing through the coil 17 during the circuit "on" period produces a magnetic field in the device parallel to the axis of the magnetic device 19. This type of polarization is necessary to produce a longitudinal extension of a magnetostrictive transducer when a magnetic field is applied by another coil (not shown) which opposes the polarization field.

Figure 2:
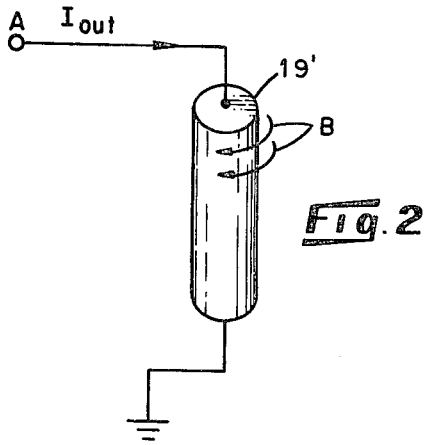
FIG. 2 is a schematic illustration in which output current ($I_{out}$), as in FIG. 1, is fed directly through a magnetrostrictive rod transducer to polarize and degauss the rod.

Alternatively, a circumferential polarization field (B) may be generated in a magnetic device 19', as shown in FIG. 2, by connecting the device 19' to terminal A so that the current passes through the device. This type of polarization is necessary in a magnetostrictive transducer, for example, to produce a torsional wave when a pulsed magnetic field is applied which opposes the circumferential polarization field.

In either case, the polarization bias of the device 19 is immediately removed when the circuit is switched off by removing, or changing, the voltage $V_{in}$ to the base of transistor 5 so that the transistor is switched to a non-conducting state. At this point, the tank circuit 15 will oscillate at its natural resonant frequency. This generates an a.c. voltage which is converted to an a.c. current by the converter 15, as shown in FIG. 3. The a.c. current then flows through the coil, as in FIG. 1, or through the device 19', as in FIG. 2, to degauss the device.

In operation, the circuit is enabled by applying a voltage pulse ($V_{in}$) to the base of transistor 5. The transistor immediately conducts, delivering a −5 V driving force to the voltage-to-current converter. The resulting d.c. current, see FIG. 3, is applied to the load device 19. When the voltage to the base of transistor 5 is switched off, the LC tank circuit 9 oscillates at its natural frequency. The value of resistor 7 is chosen to damp these oscillations rapidly, allowing about ten complete cycles to be converted to degaussing a.c. current by the voltage-to-current converter prior to the next biasing pulse.

The relevant parameters of the circuit for a particular application are the magnitude of the d.c. current supplied, the maximum a.c. peak current, the frequency of the a.c. current, and the number of complete cycles the a.c. current makes. All of these parameters are determined by selection of the values of the circuit components. The duration of the d.c. bias is controlled externally by the width of the input pulse ($V_{in}$).

In a test of the circuit as shown in FIG. 1, the following component values were used:

| | |
|---|---|
| Transistor 5 | 2N3904 |
| Resistor 7 | 100 ohms |
| Capacitor 11 | .01 mfd |
| Inductor 13 | 88 mH |

The input voltage pulses ($V_{in}$) were generated at a microcomputer port and applied at a rate of 30 pulses/sec. with each pulse having a duration (t) of 10 milliseconds. The d.c. output current during the biasing period (t), see FIG. 3, was 3 amps. The peak a.c. current was 3 amps and the damping period was 20 milliseconds allowing 10 complete cycles of degaussing current at a frequency of 500 Hz. The magnetic device used was an annealed nickel tube ⅛-inch in diameter. Since annealed nickel is a magnetically "soft" material, degaussing could be accomplished with 5 oscillations lasting 10 milliseconds. A virtue of the circuit is its suitability to many materials by adjusting both the number of oscillations and their period to match the magnetic characteristics of the magnetic device. This is accomplished by proper choice of the tank circuit and load resistor values.

In applications where more than one pulsing mode of operation is required as in a magnetostrictive transducer where both extensional, or longitudinal, waves and torsional waves are launched alternately in a sensing device, a second degaussing circuit would be employed to operate a second coil arrangement for the transducer. The two circuits would then be timed by the appropriate input pulse timing to alternately bias and degauss the transducer for the two separate operating modes.

Thus, a means has been provided for rapidly degaussing a magnetic medium, which may also be employed to alternately magnetically bias a magnetic medium and quickly degauss the medium for magnetic devices of various forms. The invention is useful in ultrasonic applications that involve rapid switching of magnetic bias between different operating modes. The invention may also provide a means of quickly degaussing magnetic shields, such as may be used in magnetic sensing devices wherein the magnetic field to be measured may polarize the shield or the sensor. The degaussing may be accomplished in a periodic fashion followed by applying a switchable bias to maximize the shielding capability of the material.

Although the invention has been illustrated by way of a specific example, it will be understood that various modifications and changes may be made therein within the scope of the invention as set forth in the following claims which form a part of this specification.

What is claimed is:

1. A degaussing circuit, comprising:
   - a magnetic device comprising a magnetic material which is to be alternately magnetically polarized and degaussed;
   - a resistor;
   - a d.c. voltage source;
   - a switching means for applying a d.c. voltage from said d.c. voltage source across said resistor for a period in response to a control signal applied thereto to turn said switching means "on";
   - a tank circuit connected in parallel with said resistor;
   - a voltage-to-current converter connected at an input thereof to said tank circuit so that a current signal is generated in an output line thereof which corresponds to the voltage applied to the input thereof from said tank circuit; and
   - a magnetic field generating means for applying a magnetic field to said magnetic material in response to said current signal from said voltage-to-current converter sufficient to polarize said magnetic material during the period said d.c. voltage is applied across said resistor and subsequently degaussing said magnetic material in response to an a.c. current generated by said voltage-to-current converter in response to an a.c. voltage generated by said tank circuit when said control signal is removed from said switching means.

2. The degaussing circuit of claim 1 wherein said switching means includes a transistor switch connected in series with said resistor between said d.c. voltage source and said resistor, said resistor being connected to ground at the other end thereof, said transistor switch including a switching electrode connected to receive said control signal so that said switch is turned "on" and "off" by said control signal for selected periods.

3. The degaussing circuit as set forth in claim 2 wherein said magnetic device is a magnetostrictive transducer.

4. The degaussing circuit as set forth in claim 2 wherein said tank circuit includes a capacitor and an inductor each connected in parallel with said resistor and each of a selected value to generate a preselected natural resonant frequency a.c. voltage when said switch is turned "off" and said resistor being of a value to damp said a.c. voltage from said tank circuit over a preselected degaussing period.

5. The degaussing circuit as set forth in claim 4 wherein said magnetic field generating means includes a coil connected to the output of said voltage-to-current converter and disposed relative to said magnetic device to effect a desired magnetic polarization of said magnetic material.

6. The degaussing circuit as set forth in claim 4 wherein said magnetic field generating means includes means for passing the current from said voltage-to-current converter through said magnetic material in a direction to effect a desired magnetic polarization of said magnetic material.

* * * * *